US012185770B2

(12) United States Patent
Zheng

(10) Patent No.: US 12,185,770 B2
(45) Date of Patent: Jan. 7, 2025

(54) NURSING BRA

(71) Applicant: SHENZHEN ROOT INNOVATION TECHNOLOGY CO., LTD., Shenzhen (CN)

(72) Inventor: Yongge Zheng, Shenzhen (CN)

(73) Assignee: SHENZHEN ROOT INNOVATION TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/367,394

(22) Filed: Jul. 4, 2021

(65) Prior Publication Data

US 2022/0386711 A1 Dec. 8, 2022

(30) Foreign Application Priority Data

Jun. 3, 2021 (CN) ..... 202110619064.X

(51) Int. Cl.
*A41C 3/04* (2006.01)
*A41C 3/00* (2006.01)

(52) U.S. Cl.
CPC ..... *A41C 3/04* (2013.01); *A41C 3/0021* (2013.01)

(58) Field of Classification Search
CPC ..... A41C 3/04
See application file for complete search history.

(56) References Cited

U.S. PATENT DOCUMENTS 3,002,515 A * 10/1961 Glogover ..... A41C 3/04 450/36
8,307,463 B2 * 11/2012 Ritchie ..... A41C 3/04 2/104
11,006,678 B1 * 5/2021 Ye ..... A41C 3/04
2008/0022434 A1 * 1/2008 Adelman ..... A41D 1/215 2/104
2009/0203295 A1 * 8/2009 Kassel ..... A41C 3/04 604/385.07
2011/0092134 A1 * 4/2011 Alva ..... A61M 1/062 450/39

(Continued)

FOREIGN PATENT DOCUMENTS

CN 209202177 U 8/2019
CN 209788515 U 12/2019

(Continued)

OTHER PUBLICATIONS

First Office Action issued in counterpart Chinese Patent Application No. 202110619064.X, dated Feb. 18, 2022.

(Continued)

*Primary Examiner* — Jocelyn Bravo
(74) *Attorney, Agent, or Firm* — Westbridge IP LLC

(57) ABSTRACT

A nursing bra includes a cover body and a partition layer. The cover body has an elastic outer layer and an elastic inner layer, an upper side of the outer layer is connected with an upper side of the inner layer, a lower side of the outer layer is connected with a lower side of the inner layer, an outer side of the inner layer is disposed at an inner side of the outer layer. The partition layer is disposed at an outer side of the outer layer and detachably connected with the cover body. When the partition layer is detached from the cover body, the outer layer and the inner layer are able to stagger from each other so as to form a feeding access to expose a breast of a user.

20 Claims, 5 Drawing Sheets

(56) References Cited

U.S. PATENT DOCUMENTS

| | | | | |
|---|---|---|---|---|
| 2011/0314587 | A1* | 12/2011 | Ritchie | A41C 3/04 2/104 |
| 2016/0150834 | A1* | 6/2016 | Boele | A41C 3/04 450/36 |
| 2016/0331045 | A1* | 11/2016 | Cortese | A41C 3/04 |
| 2018/0296741 | A1 | 10/2018 | Hill et al. | |
| 2019/0289926 | A1* | 9/2019 | Abbaszadeh | A41C 3/04 |
| 2020/0297042 | A1 | 9/2020 | Carlino et al. | |
| 2021/0345690 | A1* | 11/2021 | Stanton | A41C 3/04 |
| 2022/0304395 | A1* | 9/2022 | Stanton | A41C 3/0014 |

FOREIGN PATENT DOCUMENTS

| | | | |
|---|---|---|---|
| CN | 210988268 | U | 7/2020 |
| CN | 212590322 | U | 2/2021 |
| JP | 2020097797 | A | 6/2020 |

OTHER PUBLICATIONS

Refusal Decision issued in counterpart Chinese Patent Application No. 202110619064.X, dated Jan. 28, 2023.
Second Office Action issued in counterpart Chinese Patent Application No. 202110619064.X, dated Sep. 29, 2022.

* cited by examiner

NURSING BRA

CROSS-REFERENCE TO RELATED PATENT APPLICATIONS

This application claims priority to Chinese Patent Application No. 202110619064.X filed on Jun. 3, 2021, the priority benefits of which are hereby claimed.

FIELD OF THE INVENTION

The present invention relates to underwear, and specifically to a nursing bra.

BACKGROUND OF THE INVENTION

As a kind of underclothing, underwear attracts people's attention, especially for women in lactation period, which is in urgent need of a kind of comfortable and easy to breast-feeding underwear, such as a nursing bra. However, most of the existing nursing bar on the market are traditional bra, it needs to untie the whole cover body of the bra to breast feed. In addition, the existing nursing bar may be loose, which is not only uncomfortable, but also has a large exposed area, and it is easy to have an embarrassing situation when women breast feed in public places. Therefore, there is an urgent need for a kind of nursing bra specially designed for lactating women in the market, so as to facilitate breast-feeding and improve user experience.

SUMMARY OF THE INVENTION

In order to overcome the disadvantages of existing nursing bras, the present invention provides a nursing bra that can facilitate breast-feeding and improve user experience.

The present invention provides a nursing bra including: a cover body having an elastic outer layer and an elastic inner layer, an upper side of the outer layer connected with an upper side of the inner layer, a lower side of the outer layer connected with a lower side of the inner layer, an outer side of the inner layer disposed at an inner side of the outer layer; a partition layer disposed at an outer side of the outer layer and detachably connected with the cover body, and when the partition layer is detached from the cover body, the outer layer and the inner layer are able to stagger from each other so as to form a feeding access to expose a breast of a user.

In one embodiment, the nursing bra further includes at least one shoulder strap and at least one back strap, a lower side of the cover body is connected with the at least one back strap, an end of the at least one shoulder strap is connected with an upper side of the cover body, and the other end of the at least one shoulder strap is connected with the at least one back strap, such that the cover body is able to cover the breast of the user.

In one embodiment, the outer layer and the inner layer stagger from each other such that a first side of the cover body forms a first opening and a second side opposite to the first side of the cover body forms a second opening, the partition layer covers the first opening and the second opening, when the partition layer is detached from the cover body and the outer layer is pulled towards the second opening, the feeding access is formed between the first opening and the second opening so as to expose the breast of the user.

In one embodiment, a width of the inner layer is greater than a width of the outer layer.

In one embodiment, the partition layer extends from a left side of the cover body to a right side of the cover body along a first direction, and the partition layer also extends from a lower side of the cover body to an upper side of the cover body in a second direction perpendicular to the first direction.

In one embodiment, a first clasp is disposed on the upper side of the cover body, a first clasp mating element is dispose on an upper side of the partition layer, the first clasp mating element is detachably connected with the first clasp, and a lower side of the partition layer is connected with the at least one back strap.

In one embodiment, the at least one back strap includes a first back strap and a second back strap, a second clasp is disposed on the first back strap, a second clasp mating element is disposed on the second back strap, the second clasp mating element is detachably connected with the second clasp so as to fix the cover body on the breast of the user.

In one embodiment, the at least one shoulder strap includes a first shoulder strap and a second shoulder strap, an end of the first shoulder strap is connected with the first back strap, the other end of the first shoulder strap is connected with the cover body, such that a first hanging space is formed by the first shoulder strap, the first back strap and the cover body, an end of the second shoulder strap is connected with the second back strap, and the other end of the second shoulder strap is connected with the cover body, such that a second hanging space is formed by the second shoulder strap, the second back strap and the cover body.

In one embodiment, a first adjusting element is disposed on the first shoulder strap and is configured to adjust a length of the first shoulder strap, and a second adjusting element is disposed on the second shoulder strap and is configured to adjust a length of the second shoulder strap.

In one embodiment, the first adjusting element includes a first adjusting strap and a first adjusting clasp, the first adjusting strap is detachably connected with the first adjusting clasp, the second adjusting element includes a second adjusting strap and a second adjusting clasp, and the second adjusting strap is detachably connected connection with the second adjusting clasp.

The present disclosure also provides a nursing bra including: two cover bodies corresponding to two breasts of a user, each cover body including an elastic outer layer and an elastic inner layer, an upper side of the outer layer connected with an upper side of the inner layer, a lower side of the outer layer connected with a lower side of the inner layer, an outer side of the inner layer disposed at an inner side of the outer layer; a partition layer disposed at an outer side of the outer layer and detachably connected with the two cover bodies, and when the partition layer is detached from the cover body, the outer layer and the inner layer are able to stagger from each other so as to form a feeding access to expose the breast of the user.

In one embodiment, a width of the inner layer is greater than a width of the outer layer.

In one embodiment, the partition layer extends from a left side of the two cover bodies to a right side of the two cover bodies along a first direction, and the partition layer also extends from a lower side of the two cover bodies to an upper side of the two cover bodies in a second direction perpendicular to the first direction.

In one embodiment, the nursing bra further includes at least one shoulder strap and at least one back strap, a lower side of the cover body is connected with the at least one back strap, an end of the at least one shoulder strap is connected with an upper side of the cover body, and the other end of the at least one shoulder strap is connected with the at least one back strap, such that the cover body is able to cover the breast of the user.

In one embodiment, the outer layer and the inner layer stagger from each other such that a first side of the cover body forms a first opening and a second side opposite to the first side of the cover body forms a second opening, the partition layer covers the first opening and the second opening, when the partition layer is detached from the cover body and the outer layer is pulled towards the second opening, the feeding access is formed between the first opening and the second opening so as to expose the breast of the user.

In one embodiment, a first clasp is disposed on the upper side of the cover body, a first clasp mating element is dispose on an upper side of the partition layer, the first clasp mating element is detachably connected with the first clasp, and a lower side of the partition layer is connected with the at least one back strap.

In one embodiment, the at least one back strap includes a first back strap and a second back strap, a second clasp is disposed on the first back strap, a second clasp mating element is disposed on the second back strap, the second clasp mating element is detachably connected with the second clasp so as to fix the cover body on the breast of the user.

In one embodiment, the at least one shoulder strap includes a first shoulder strap and a second shoulder strap, an end of the first shoulder strap is connected with the first back strap, the other end of the first shoulder strap is connected with one of the cover body, such that a first hanging space is formed by the first shoulder strap, the first back strap and the cover body, an end of the second shoulder strap is connected with the second back strap, and the other end of the second shoulder strap is connected with the cover body, such that a second hanging space is formed by the second shoulder strap, the second back strap and the cover body.

In one embodiment, a first adjusting element is disposed on the first shoulder strap and is configured to adjust a length of the first shoulder strap, and a second adjusting element is disposed on the second shoulder strap and is configured to adjust a length of the second shoulder strap.

In one embodiment, the first adjusting element includes a first adjusting strap and a first adjusting clasp, the first adjusting strap is detachably connected with the first adjusting clasp, the second adjusting element includes a second adjusting strap and a second adjusting clasp, and the second adjusting strap is detachably connected connection with the second adjusting clasp.

The present disclosure also has the beneficial effects: the cover body has the elastic outer layer and the elastic inner layer, the upper side of the outer layer is connected with the upper side of the inner layer, the lower side of the outer layer is connected with the lower side of the inner layer, the outer side of the inner layer is disposed at the inner side of the outer layer, the nursing bra further includes the partition layer disposed at the outer side of the outer layer, and the partition layer is detachably connected with the cover body. When the partition layer is detached from the cover body, the outer layer and the inner layer are able to stagger from each other so as to form the feeding access to expose the breast of the user, such that the user can breastfeed a baby or pump milk via the feeding access. After breast-feeding or milk-pumping, the partition layer can be connected with the cover body and the partition layer is located at the outer side of the cover body, which can not only effectively prevent the user from accidentally exposing the breast by the feeding access when wearing the nursing bra, causing an embarrassing situation, but also make the appearance of the nursing bra smooth and beautiful, further improving the wearing comfort of the nursing bra.

BRIEF DESCRIPTIONS OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application. For ordinary skill in the art, they may obtain other drawings according to these attached drawings without any innovative laboring.

The present disclosure will be further described with reference to the attached drawings and the embodiments hereunder:

DETAILED DESCRIPTION OF THE ILLUSTRATED EMBODIMENTS

In order to provide a clear understanding of the objects, features, and advantages of the embodiments, the following are detailed and complete descriptions to the technological solutions adopted in the embodiments. Obviously, the descriptions are part of the whole embodiments. The other embodiments which are not processed creatively by technicians of ordinary skills in the field are under the protection of this disclosure. The same is given with reference to the drawings and specific embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The invention, with reference to the accompanying drawings, is illustrated by way of examples and not by way of limitation. It should be noted that references to "an" or "one" embodiment in this disclosure are not necessarily to the same embodiment, and such references mean "at least one."

Figure 1:
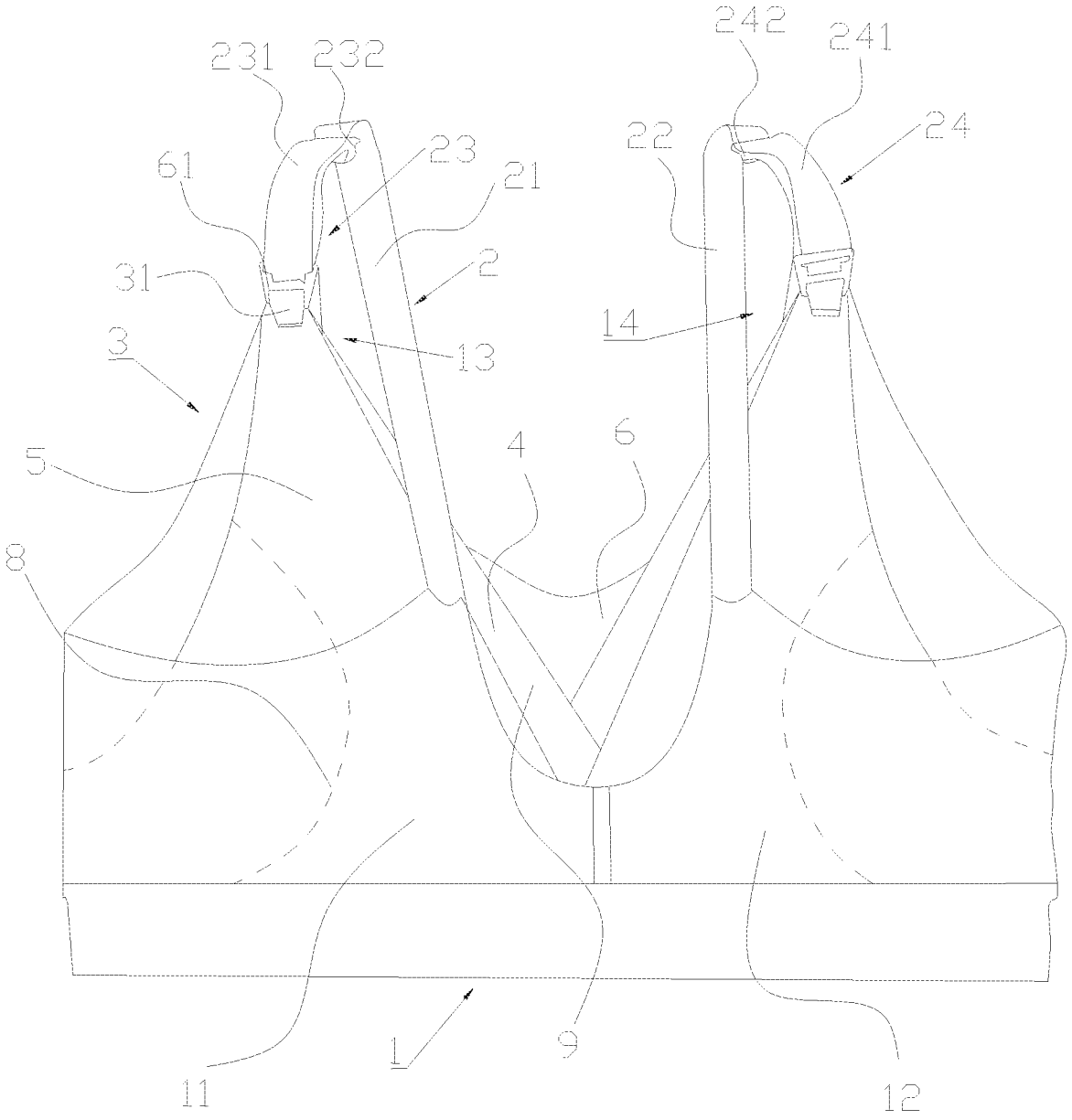
FIG. 1 is a schematic view of a nursing bra according to an embodiment of the present invention.
Figure 2:
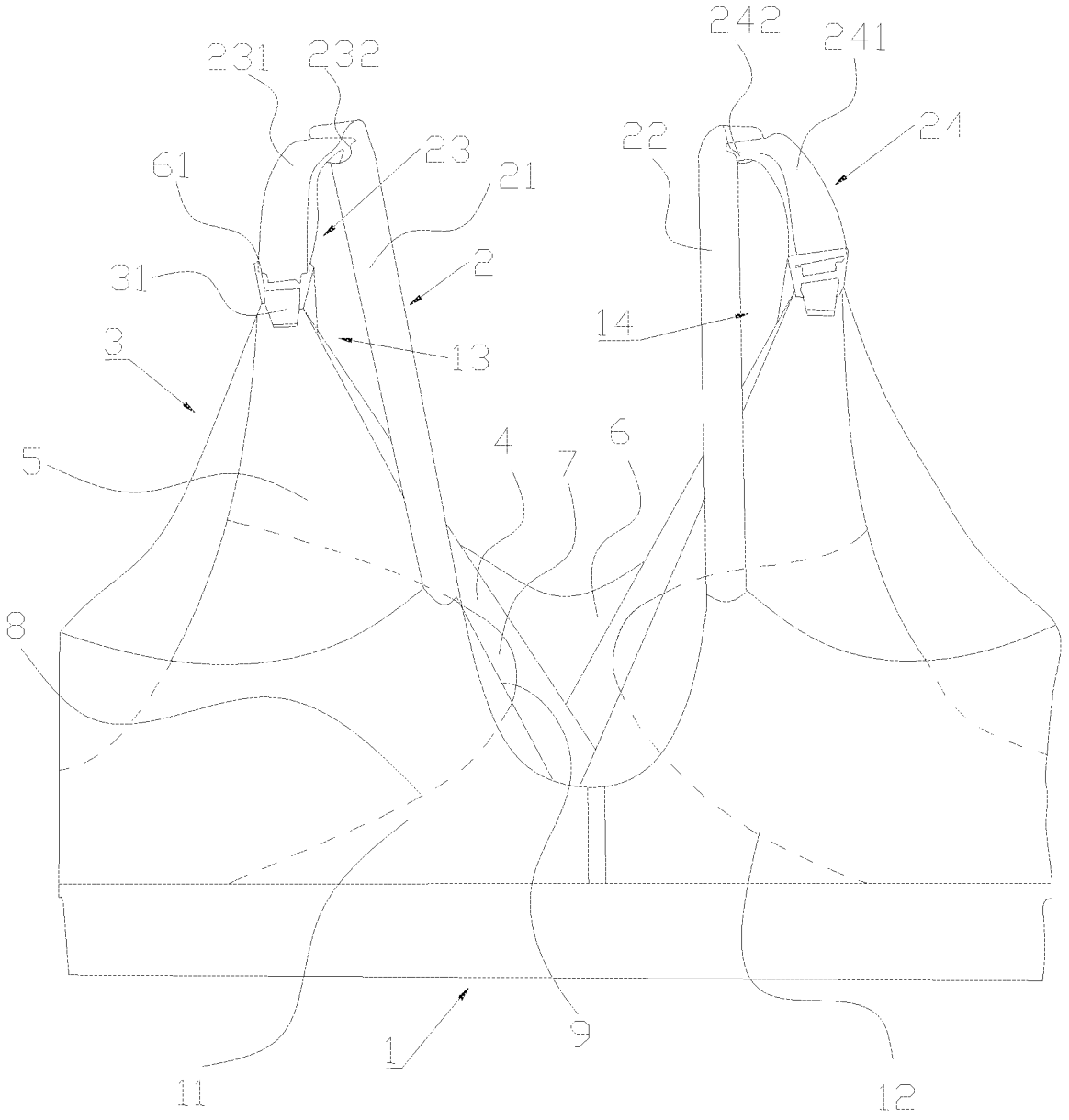
FIG. 2 is a change state view of the nursing bra of FIG. 1 when an outer layer of the nursing bra is pulled towards a second opening.
Figure 3:
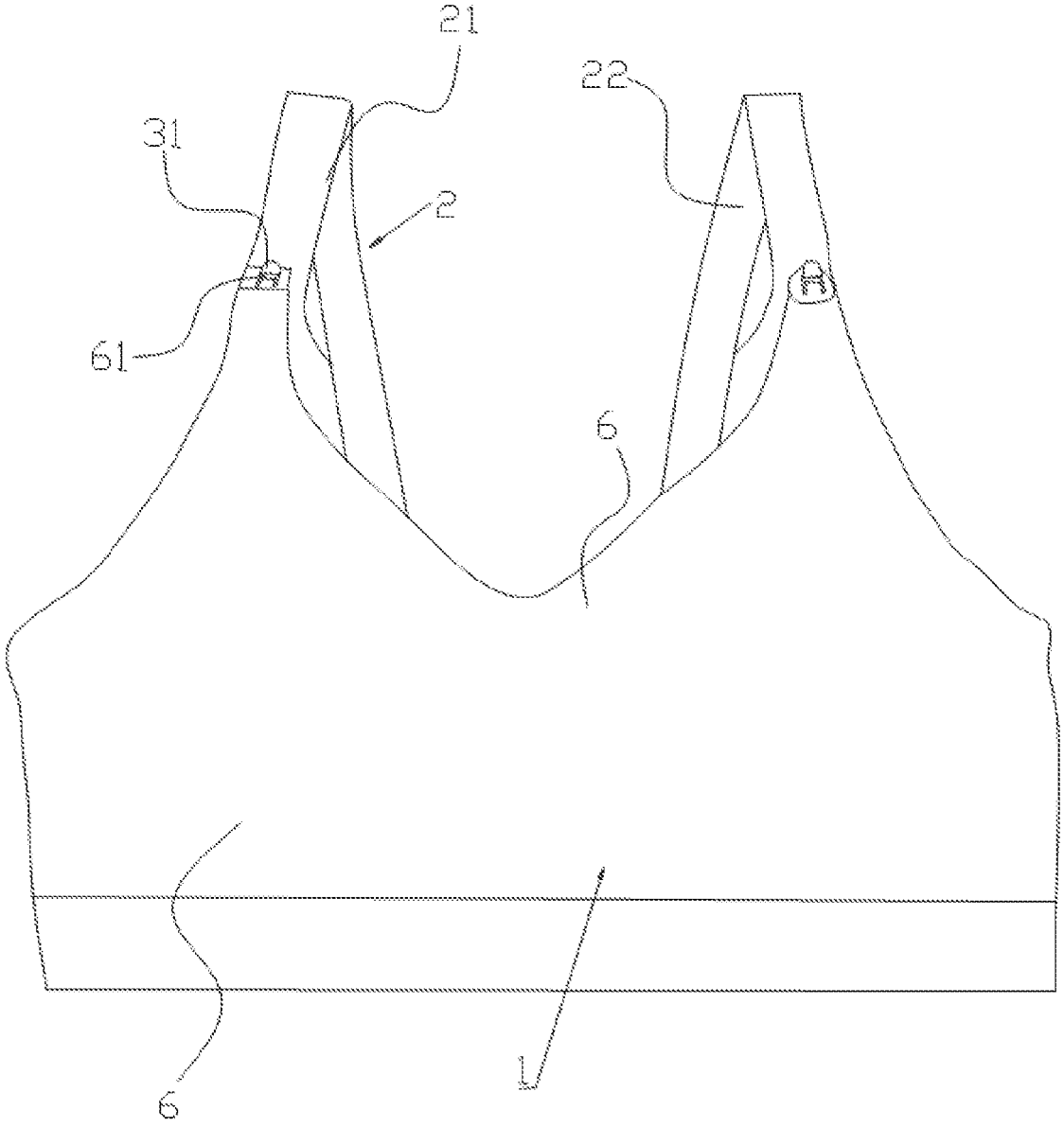
FIG. 3 is a schematic view of a partition layer of the nursing bra of FIG. 1.
Figure 4:
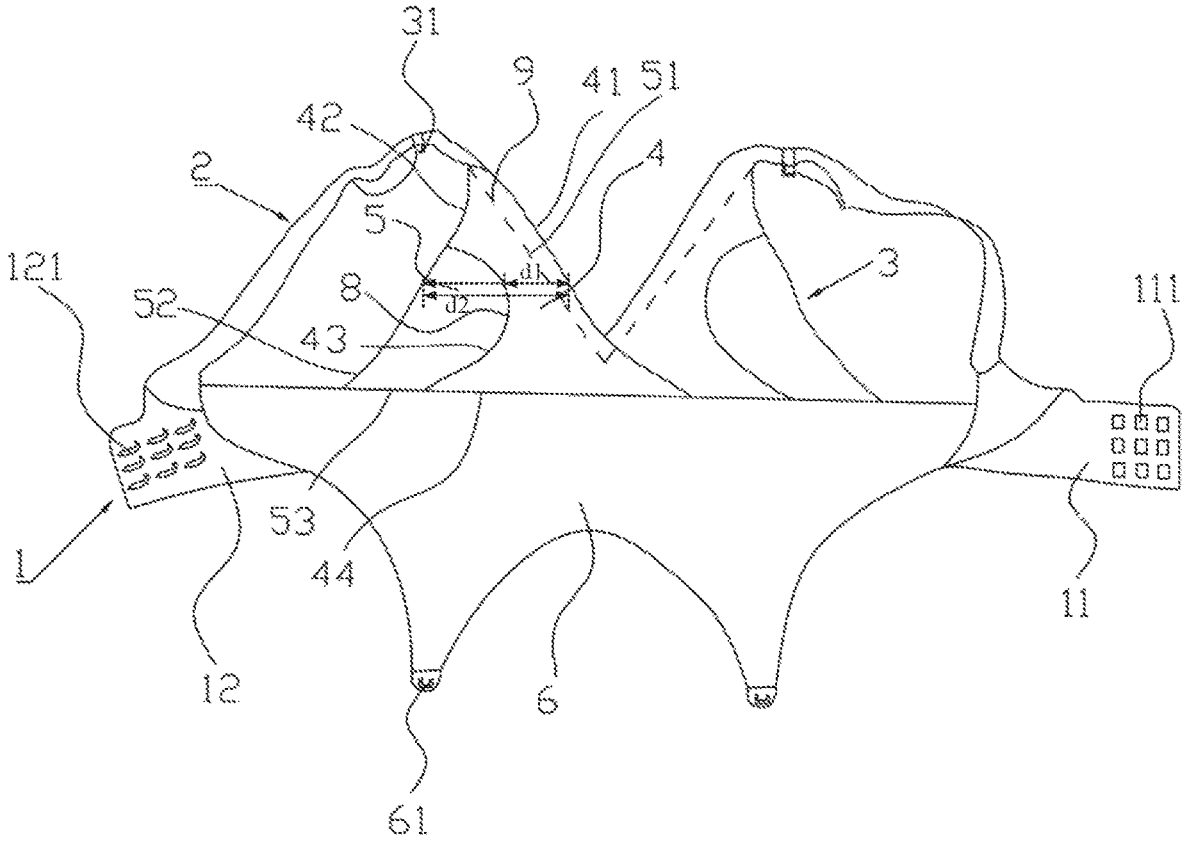
FIG. 4 is an another schematic view of the nursing bra of FIG. 1 when the partition layer is detached away from a cover body of FIG. 1.
Figure 5:
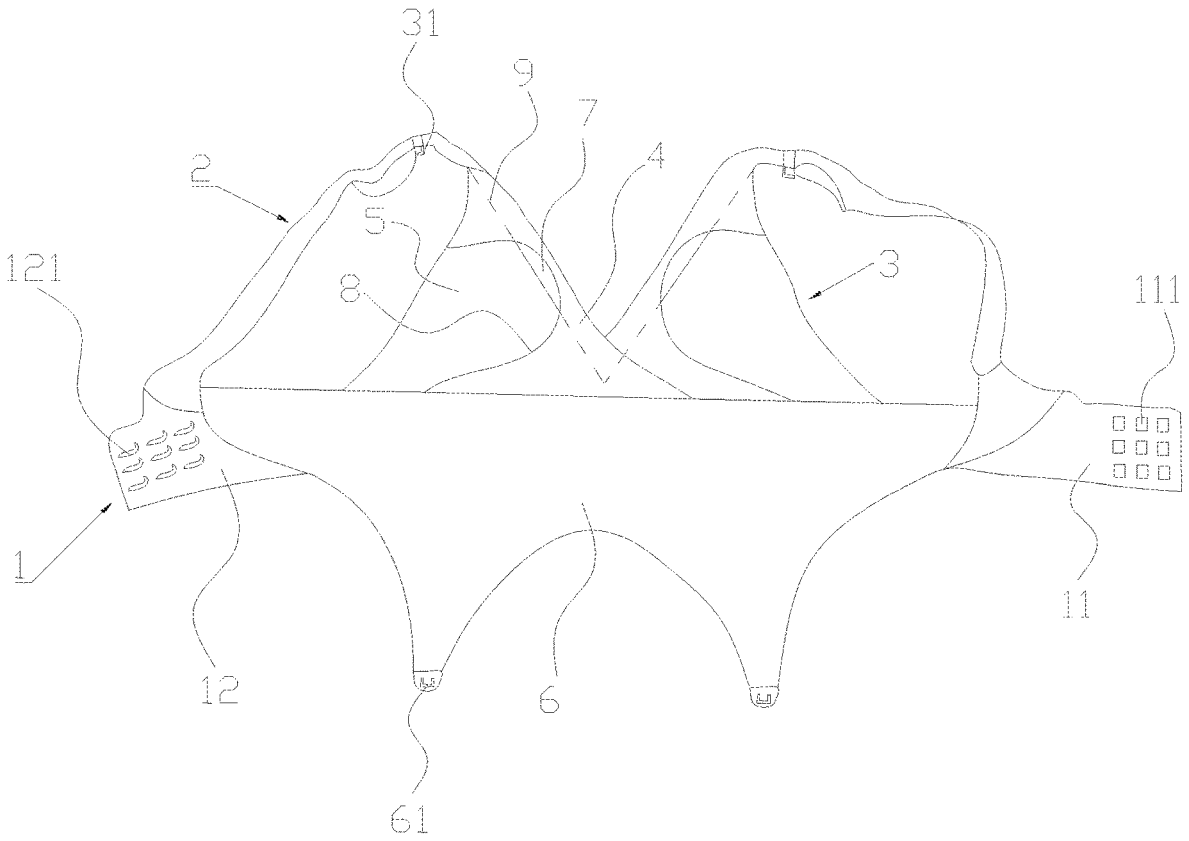
FIG. 5 is another change state view of the nursing bra of FIG. 1 when the outer layer of the nursing bra is pulled towards the second opening.

Referring to FIGS. 1-5, a nursing bra includes two cover bodies 3 corresponding to two breasts of a user, and each cover body has an elastic outer layer 4 and an elastic inner layer 5. he upper side of the outer layer 4 is connected with an upper side of the inner layer 5, a lower side of the outer layer 4 is connected with a lower side of the inner layer 5, an outer side of the inner layer 5 is disposed at an inner side of the outer layer 4. The nursing bra further includes a partition layer 6 disposed at an outer side of the outer layer 4, and the partition layer 6 is detachably connected with the cover body 3. When the partition layer 6 is detached from the cover body 3, the outer layer 4 and the inner layer 5 are able to stagger from each other so as to form a feeding access 7 to expose one breast of the user.

Through the above structure, the cover body 3 has the elastic outer layer 4 and the elastic inner layer 5, the upper side of the outer layer 4 is connected with the upper side of the inner layer 5, the lower side of the outer layer 4 is connected with the lower side of the inner layer 5, the outer side of the inner layer 5 is disposed at the inner side of the outer layer 4, the nursing bra further includes the partition layer 6 disposed at the outer side of the outer layer 4, and the partition layer 6 is detachably connected with the cover body 3. When the partition layer 6 is detached from the cover body 3, the outer layer 4 and the inner layer 5 are able to stagger from each other so as to form the feeding access 7 to expose the breast of the user, such that the user can breastfeed a baby or pump milk via the feeding access 7. After breast-feeding or milk-pumping, the partition layer 6 can be connected with the cover body 3 and the partition layer 6 is located at the outer side of the cover body 3, which can not only effectively prevent the user from accidentally exposing the breast by the feeding access 7 when wearing the nursing bra, causing an embarrassing situation, but also make the appearance of the nursing bra smooth and beautiful, further improving the wearing comfort of the nursing bra.

In the embodiment, the nursing bra further includes at least one shoulder strap 2 and at least one back strap 1, a lower side of the cover body 3 is connected with the at least one back strap 1, an end of the at least one shoulder strap 2 is connected with an upper side of the cover body 3, and the other end of the at least one shoulder strap 2 is connected with the at least one back strap 1, such that the cover body 3 is able to cover the at least one breast of the user. It can be understood, the cover body 3 may cover two breasts of the users.

In the embodiment, the outer layer 4 and the inner layer 5 stagger from each other such that a first side of the cover body 3 forms a first opening 8 and a second side opposite to the first side of the cover body 3 forms at least one second opening 9, and the partition layer 6 covers the first opening 8 and the second opening 9. When the partition layer 6 is detached from the cover body 3 and the outer layer 4 is pulled towards the second opening 9, the feeding access 7 is formed between the first opening 8 and the second opening 9 so as to expose the breast of the user. For example, the first opening 8 can be located between a right side of the outer layer 4 and a right side of the inner layer 5, and the second opening 9 can be located between a left side of the outer layer 4 and a left side of the inner layer 5. Through the above structure, when the user need to feeding baby or pump milk, the partition layer 6 can be detached from the cover body 3, and the outer layer 4 can be pulled towards the second opening 9 to communicate the first opening 8 and the second opening 9 and form the feed access 7 for breast-feeding or milk-pumping. After breast-feeding or milk-pumping, the partition layer 6 can be connected with the cover body 3 and overlap with the outer layer 4 and cover the first opening 8 and the second opening 9, which can not only effectively prevent the user from accidentally exposing the breast by the feeding access 7 when wearing the nursing bra, causing an embarrassing situation, but also make the appearance of the nursing bra smooth and beautiful, further improving the wearing comfort of the nursing bra.

The outer layer 4 includes a first edge 41, a second edge 42, a third edge 43 and a fourth edge 44. The first edge 41 and the second edge 42 are connected with the shoulder strap 2. The second edge 42 is located at the upper side of the outer layer 4 and is connected with the inner layer 5. The fourth edge 44 is located at the lower side of the outer layer 4 and is connected with the inner layer 5. The third edge 43 is connected between the second edge 42 and the fourth edge 44 and is configured to form the first opening 8. The inner layer 5 includes a fifth edge 51, a sixth edge 52 and a seventh edge 53. The fifth edge 51 is located at the second side of the inner layer 5 and configured to form the second opening 9, the seventh edge 53 is located at the lower side of the inner layer 5 and is connected with the fourth edge 44. The sixth edge 52 is connected between the fifth edge 51 and the seventh edge 53, and the fifth edge 51, the sixth edge 52 and the seventh edge 53 form a triangle substantially. In non-breast-feeding or non-milk-pumping state, the inner layer 4 and the outer layer 5 overlap each other such that an overlapping region is formed between the third edge 43 and the fifth edge 51, and the third edge 43 is arc-shaped and a protruding direction of the arc-shaped third edge 43 extends towards the second opening 9. In addition, a minimum width d1 of the outer layer 4 along a first direction is a width d2 of the inner layer 5 along the first direction at a corresponding position. A direction from the upper side of the inner layer 5 to the lower side of the inner layer 5 is taken as a second direction, and the first direction is perpendicular to the second direction. The corresponding position is corresponding to a position of the outer layer 4 with the minimum width d1. Through the above structure, the user can quickly and accurately stagger the outer layer 4 and the inner layer 5 to form the feeding access 7 to expose the breast from the cover body 3.

Furthermore, the partition layer 6 extends from the left side of the cover body 3 to the right side of the cover body 3 along the first direction, and the partition layer 6 also extends from a lower side of the cover body 3 to an upper side of the cover body 3 in the second direction perpendicular to the first direction. Through the above structure, the partition layer 6 covers the outer layer 4 and the inner layer 5 completely, which can not only make the appearance of the nursing bra smooth and beautiful, but also effectively prevent the user from accidentally exposing the breast by the feeding access 7 when wearing the nursing bra, causing an embarrassing situation.

In the embodiment, a first clasp 31 is disposed on the upper side of the cover body 3, a first clasp mating element 61 is dispose on an upper side of the partition layer 6, the first clasp mating element 61 is detachably connected with the first clasp 31, and a lower side of the partition layer 6 is connected with the at least one back strap 1. Through the above structure, when it needs to breast feed or pump milk, the first clasp mating element 61 is detached from the first clasp 31 such that the partition layer 6 is detached from the cover body 3. After breast-feeding or milk-pumping, the first clasp mating element 61 can be connected with the first clasp 31, such that the partition layer 6 covers the cover body 3 which is rough by the first opening 8 and the second opening 9, causing the appearance of the nursing bra beautiful. Further, a lower side of the partition layer 6 can be not connected with the at least one back strap 1, but the first clasp mating element 61 is detachably connected with the first clasp 31 to make the partition layer 6 cover the cover body 3.

In the embodiment, the at least one back strap 1 includes a first back strap 11 and a second back strap 12, a second clasp 111 is disposed on the first back strap 11, a second clasp mating element 121 is disposed on the second back strap 12, the second clasp mating element 121 is detachably connected with the second clasp 111 so as to fix the cover body 3 on the breast of the user. Through the above structure, when the second clasp 111 is connected with the second clasp mating element 121, the connection between the first back strap 11 and the second back strap 12 is realized, such that a set space is formed between the first back strap 11, the second back strap 12 and the cover body 3, so as to fix the cover body 3 and the partition layer 6 on the user's breast. When the user needs to take off the nursing bar, the first back strap 11 and the second back strap 12 can be separated by detaching the second clasp 111 from the second clasp mating element 121, so as to open the set space and facilitate the user to take off the nursing bra.

In the embodiment, the at least one shoulder strap 2 includes a first shoulder strap 21 and a second shoulder strap 22, an end of the first shoulder strap 21 is connected with the first back strap 11, the other end of the first shoulder strap 22 is connected with the cover body 3, such that a first hanging space is formed by the first shoulder strap 21, the first back strap 11 and the cover body 3. An end of the second shoulder strap 22 is connected with the second back strap 12, and the other end of the second shoulder strap 22 is connected with the cover body 3, such that a second hanging space is formed by the second shoulder strap 22, the second back strap 12 and the cover body 3. Through the above structure, the nursing bra can be hung on the user's body through the first hanging space and the second hanging space, and the nursing bra can be more stably hung on the user's body, especially when the user is breast-feeding, the nursing bra can be prevented from loosening.

Further, a first adjusting element 23 is disposed on the first shoulder strap 21 and is configured to adjust a length of the first shoulder strap 21, and a second adjusting element 24 is disposed on the second shoulder strap 22 and is configured to adjust a length of the second shoulder strap 22. Through the above structure, the user can use the first adjusting element 23 to adjust the length of the first shoulder strap 21, and use the second adjusting element 24 to adjust the length of the second shoulder strap 22, such that the user can adjust the length of the shoulder strap 2 according to actual chest circumference, and the user can hang the nursing bra on the user's body more comfortably through the shoulder strap.

In detail, the first adjusting element 23 includes a first adjusting strap 231 and a first adjusting clasp 232, the first adjusting strap 231 is detachably connected with the first adjusting clasp 232, the second adjusting element 24 includes a second adjusting strap 241 and a second adjusting clasp 242, and the second adjusting strap 241 is detachably connected with the second adjusting clasp 242. Through the above structure, the function of adjusting the length of the shoulder strap 2 by the first adjusting element 23 and the second adjusting element 24 is effectively realized.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and scope of the technical solutions of the respective embodiments of the disclosure.

What is claimed as new and desired to be protected by Letters Patent, is:

1. A nursing bra, comprising a cover body comprising an elastic outer layer and an elastic inner layer, an upper side of the outer layer connected with an upper side of the inner layer, a lower side of the outer layer connected with a lower side of the inner layer, an outer side of the inner layer disposed at an inner side of the outer layer, a partition layer disposed at an outer side of the outer layer and detachably connected with the cover body, wherein the outer layer and the inner layer are staggered from each other such that a first side of the cover body forms a first opening and a second side opposite to the first side of the cover body forms a second opening, and the partition layer covers the first opening and the second opening, wherein, when the partition layer is detached from the cover body and the outer layer is pulled towards the second opening, a feeding access is formed between the first opening and the second opening, and the feeding access is configured to expose a breast of a user, wherein the outer layer includes a first edge, a second edge, a third edge and a fourth edge, the second edge is located at the upper side of the outer layer and is connected with the inner layer, the fourth edge is located at the lower side of the outer layer and is connected with the inner layer, the third edge is connected between the second edge and the fourth edge and configured to form the first opening, wherein the inner layer includes a fifth edge, a sixth edge and a seventh edge, the fifth edge is located at the second side of the cover body and configured to form the second opening, the seventh edge is located at the lower side of the inner layer and is connected with the fourth edge, the sixth edge is connected between the fifth edge and the seventh edge, the third edge is located between the fifth edge and the sixth edge, and the fifth edge is located between the third edge and the first edge;

wherein, in a non-breast-feeding state or a non-milk-pumping state, the inner layer and the outer layer overlap each other to form an overlapping region between the third edge and the fifth edge so as to protect the breast of the user from being exposed; and wherein in a breast-feeding state or a milk-pumping state, the third edge is configured to be pulled to reduce a size of the overlapping region so as to expose the breast of the user.

2. The nursing bra according to claim 1, wherein the nursing bra further comprises at least one shoulder strap and at least one back strap, a lower side of the cover body is connected with the at least one back strap, an end of the at least one shoulder strap is connected with an upper side of the cover body, and the other end of the at least one shoulder strap is connected with the at least one back strap, the cover body is configured to cover the breast of the user.

3. The nursing bra according to claim 2, wherein a first clasp is disposed on the upper side of the cover body, a first clasp mating element is disposed on an upper side of the partition layer, the first clasp mating element is detachably connected with the first clasp, and a lower side of the partition layer is connected with the at least one back strap.

4. The nursing bra according to claim 2, wherein the at least one back strap comprises a first back strap and a second back strap, a second clasp is disposed on the first back strap, a second clasp mating element is disposed on the second back strap, the second clasp mating element is detachably connected with the second clasp, the second clasp mating element and the second clasp are configured to fix the cover body on the breast of the user.

5. The nursing bra according to claim 4, wherein the at least one shoulder strap comprises a first shoulder strap and a second shoulder strap, an end of the first shoulder strap is connected with the first back strap, the other end of the first shoulder strap is connected with the cover body, such that a first hanging space is formed by the first shoulder strap, the first back strap and the cover body, an end of the second shoulder strap is connected with the second back strap, and the other end of the second shoulder strap is connected with the cover body, such that a second hanging space is formed by the second shoulder strap, the second back strap and the cover body.

6. The nursing bra according to claim 5, wherein a first adjusting element is disposed on the first shoulder strap and is configured to adjust a length of the first shoulder strap, and a second adjusting element is disposed on the second shoulder strap and is configured to adjust a length of the second shoulder strap.

7. The nursing bra according to claim 6, wherein the first adjusting element comprises a first adjusting strap and a first adjusting clasp, the first adjusting strap is detachably connected with the first adjusting clasp, the second adjusting element comprises a second adjusting strap and a second adjusting clasp, and the second adjusting strap is detachably connected with the second adjusting clasp.

8. The nursing bra according to claim 1, wherein the nursing bra defines a first direction and a second direction, wherein the first direction is a direction that extends from a first side of the cover body towards the second side of the cover body, the second direction is a direction that extends from the upper side of the inner layer towards the lower side of the inner layer, and the first and second directions are perpendicular to one another; and wherein a minimum width of the inner layer along the first direction is greater than a width of the outer layer along the first direction at a corresponding position.

9. The nursing bra according to claim 8, wherein the partition layer extends from a left side of the cover body to a right side of the cover body along the first direction, and the partition layer also extends from a lower side of the cover body to an upper side of the cover body in the second direction perpendicular to the first direction.

10. The nursing bra according to claim 1, wherein, in the non-breast-feeding state or the non-milk-pumping state, the third edge is arc-shaped and a protruding direction of the arc-shaped third edge extends towards the second opening.

11. A nursing bra, comprising two cover bodies corresponding to two breasts of a user, each cover body comprising an elastic outer layer and an elastic inner layer, an upper side of the outer layer connected with an upper side of the inner layer, a lower side of the outer layer connected with a lower side of the inner layer, an outer side of the inner layer disposed at an inner side of the outer layer, a partition layer disposed at an outer side of each outer layer and detachably connected with the two cover bodies, wherein in each cover body, the outer layer and the inner layer are staggered from each other such that a first side of the cover body forms a first opening and a second side opposite to the first side of the cover body forms a second opening, and the partition layer covers the first opening and the second opening; wherein, when the partition layer is detached from the cover body and the outer layer is pulled towards the second opening, a feeding access is formed between the first opening and the second opening, and the feeding access is configured to expose a breast of a user, wherein the outer layer includes a first edge, a second edge, a third edge and a fourth edge, the second edge is located at an upper side of the outer layer and is connected with the inner layer, the fourth edge is located at the lower side of the outer layer and is connected with the inner layer, the third edge is connected between the second edge and the fourth edge and configured to form the first opening, wherein the inner layer includes a fifth edge, a sixth edge and a seventh edge, the fifth edge is located at the second side of the cover body and configured to form the second opening, the seventh edge is located at the lower side of the inner layer and is connected with the fourth edge, the sixth edge is connected between the fifth edge and the seventh edge, the third edge is located between the fifth edge and the sixth edge, and the fifth edge is located between the third edge and the first edge;

wherein, in a non-breast-feeding state or a non-milk-pumping state, the inner layer and the outer layer overlap each other to form an overlapping region between the third edge and the fifth edge so as to protect the breast of the user from being exposed; and wherein in a breast-feeding state or a milk-pumping state, the third edge is configured to be pulled to reduce a size of the overlapping region so as to expose the breast of the user.

12. The nursing bra according to claim 11, wherein a width of the inner layer along a first direction perpendicular to a second direction from the upper side of the inner layer to the lower side of the inner layer is greater than a width of the outer layer along the first direction.

13. The nursing bra according to claim 12, wherein the partition layer extends from a left side of the two cover bodies to a right side of the two cover bodies along the first direction, and the partition layer also extends from a lower side of the two cover bodies to an upper side of the two cover bodies in the second direction perpendicular to the first direction.

14. The nursing bra according to claim 11, wherein the nursing bra further comprises at least one shoulder strap and at least one back strap, a lower side of at least one cover body of the cover bodies is connected with the at least one back strap, an end of the at least one shoulder strap is connected with an upper side of the at least one cover body, and the other end of the at least one shoulder strap is connected with the at least one back strap, such that the at least one cover body is configured to cover the breast of the user, and the fifth edge, the sixth edge and the seventh edge form a triangle.

15. The nursing bra according to claim 14, wherein a first clasp is disposed on the upper side of each cover body, a first clasp mating element is disposed on an upper side of the partition layer, the first clasp mating element is detachably connected with the first clasp, and a lower side of the partition layer is connected with the at least one back strap.

16. The nursing bra according to claim 14, wherein the at least one back strap comprises a first back strap and a second back strap, a second clasp is disposed on the first back strap, a second clasp mating element is disposed on the second back strap, the second clasp mating element is detachably connected with the second clasp so as to fix a corresponding cover body of the cover bodies on the breast of the user.

17. The nursing bra according to claim 16, wherein the at least one shoulder strap comprises a first shoulder strap and a second shoulder strap, an end of the first shoulder strap is connected with the first back strap, the other end of the first shoulder strap is connected with a first cover body of the cover bodies, such that a first hanging space is formed by the first shoulder strap, the first back strap and the first cover body, an end of the second shoulder strap is connected with the second back strap, and the other end of the second shoulder strap is connected with a second cover body of the cover bodies, such that a second hanging space is formed by the second shoulder strap, the second back strap and the second cover body.

18. The nursing bra according to claim 17, wherein a first adjusting element is disposed on the first shoulder strap and is configured to adjust a length of the first shoulder strap, and a second adjusting element is disposed on the second shoulder strap and is configured to adjust a length of the second shoulder strap.

19. The nursing bra according to claim 18, wherein the first adjusting element comprises a first adjusting strap and a first adjusting clasp, the first adjusting strap is detachably connected with the first adjusting clasp, the second adjusting element comprises a second adjusting strap and a second adjusting clasp, and the second adjusting strap is detachably connected with the second adjusting clasp.

20. The nursing bra according to claim 11, wherein, in the non-breast-feeding state or the non-milk-pumping state, the third edge is arc-shaped and a protruding direction of the arc-shaped third edge extends towards the second opening.

* * * * *